313-414

6/23/81 OR 4,275,332 SR

United States Patent [19]

Ashizaki et al.

[11] 4,275,332

[45] Jun. 23, 1981

[54] IN-LINE ELECTRON GUN

[75] Inventors: Shigeya Ashizaki, Takatsuki; Hideo Muranishi, Osaka; Koichi Sugahara, Sakai, all of Japan

[73] Assignee: Matsushita Electronics Corporation, Osaka, Japan

[21] Appl. No.: 58,919

[22] Filed: Jul. 19, 1979

[30] Foreign Application Priority Data

Jul. 25, 1978 [JP] Japan ..... 53-91134
Mar. 20, 1979 [JP] Japan ..... 54-32780
Mar. 27, 1979 [JP] Japan ..... 54-36082

[51] Int. Cl.[3] ..... H01J 29/50
[52] U.S. Cl. ..... 313/414; 313/409
[58] Field of Search ..... 313/409, 411, 412, 413, 313/414

[56] References Cited

U.S. PATENT DOCUMENTS 4,119,884 10/1978 Blumenberg et al. ..... 313/414 X

*Primary Examiner*—Palmer C. Demeo
*Assistant Examiner*—Darwin R. Hostetter
*Attorney, Agent, or Firm*—Burgess, Ryan and Wayne

[57] ABSTRACT

In an in-line electron gun, three apertures, closer to an accelerating electrode, of a focusing electrode, which forms three main electron lenses, are defined by bridging with a partition electrode means two neck portions of a peanut-shaped aperture consisting of a center or inner aperture and two outer apertures which partially overlap the center or inner aperture and are contiguous therewith, thus forming a continuous aperture in the form of a peanut pod having three seeds.

9 Claims, 12 Drawing Figures

IN-LINE ELECTRON GUN

BACKGROUND OF THE INVENTION

The present invention relates to an in-line electron gun adapted to be incorporated in a color picture tube.

In general, focusing characteristics of picture tubes are greatly influenced by the diameter of main lenses. That is, the greater the diameter of main lenses, the better the focusing characteristics become. In the in-line electron gun, however, in order to obtain a large diameter of three main lenses, the diameter of three apertures, which are arranged in line, must be increased and consequently the spacing between the beam paths must be also increased. Then it becomes extremely difficult to attain the correct convergence of three electron beams. Furthermore the focusing electrode for forming the main lenses becomes large in size and must be located closer to the neck portion of the glass bulb so that sparks result; that is, resistance to high voltage or the high voltage characteristic is degraded.

As a result, the diameter of the main lenses in an in-line electron gun must be determined by a compromise between focusing, convergence and high voltage characteristics.

SUMMARY OF THE INVENTION

Accordingly, the main object of the present invention is to provide an in-line electron gun which may have three main lenses with a large diameter without an increase in the spacing between the beam paths, so that satisfactory convergence and high voltage characteristics may be ensured.

DESCRIPTION OF THE PREFERRED EMBODIMENTS

Figure 1:
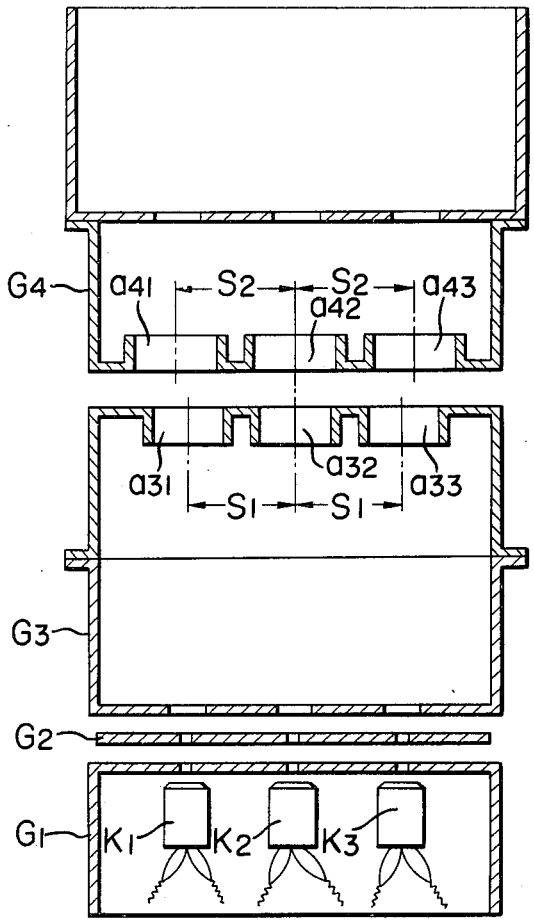
FIG. 1 PRIOR ART
FIG. 1 is an axial sectional view of a prior art in-line electron gun.

Prior Art, FIG. 1

FIG. 1 is an axial sectional view of a prior art bipotential type in-line electron gun comprising a pre-triode consisting of three cathodes $K_1$, $K_2$ and $K_3$, a control grid $G_1$ and an accelerating grid $G_2$, a main lens forming electrode or focusing electrode $G_3$ and a final accelerating electrode $G_4$. The focusing and accelerating electrodes $G_3$ and $G_4$ are formed with circular apertures $a_{31}$, $a_{32}$ and $a_{33}$ and $a_{41}$, $a_{42}$ and $a_{43}$, respectively, each set of apertures being situated in line. As disclosed in detail in Hughes U.S. Pat. No. 3,772,554, the spacings $S_2$ between the beam paths are made slightly greater than the spacings $S_1$ in order to converge the three in-line electron beams.

Figure 3:
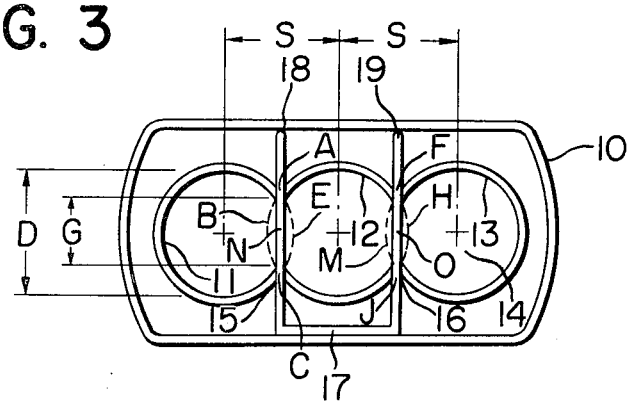
FIG. 3 is a vertical sectional view of a focusing electrode thereof.
Figure 2:
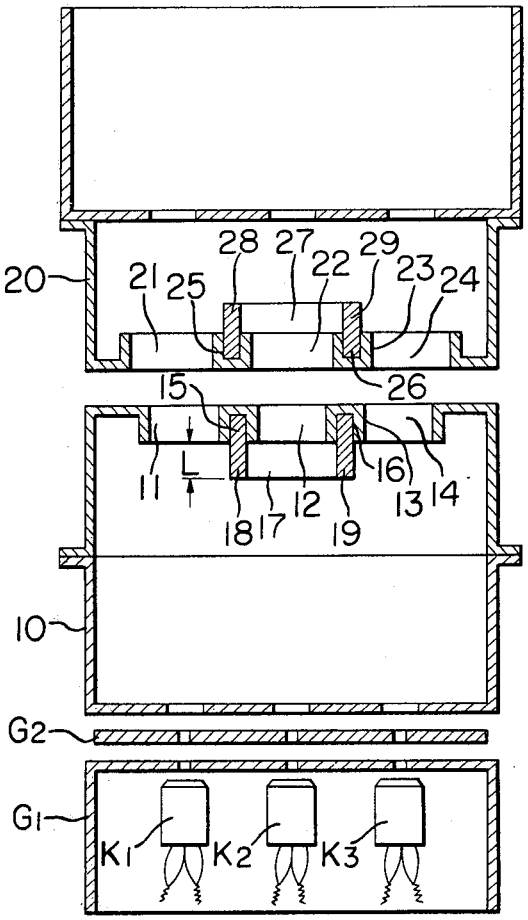
FIG. 2 is an axial sectional view of a first embodiment of an in-line electron gun in accordance with the present invention.
Figure 4:
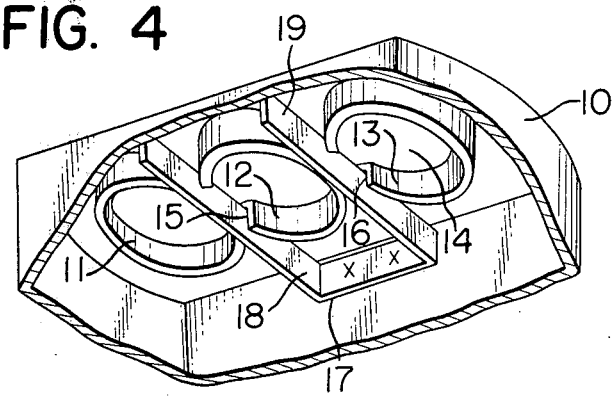
FIG. 4 is a perspective view, partly broken, of the focusing electrode shown in FIG. 3.

The Invention, First Embodiment, FIGS. 2–4

In FIGS. 2–4 is shown a first embodiment of an in-line electron gun in accordance with the present invention. The bottom of one of the cup-shaped members of the focusing electrode 10, which is closer to the accelerating electrode 20, is formed with three in-line apertures 11, 12 and 13 each having a flange extending backwardly toward the cathodes $K_1$, $K_2$ and $K_3$. The outer apertures 11 and 13 are so shaped as to partially overlap the inner aperture 12 as best shown in FIG. 3 so that the three apertures 11, 12 and 13 are contiguous and in the form of a peanut pod containing three seeds. These contiguous apertures, therefore, will be referred to as "the peanut-shaped contiguous aperture 14" in this specification. Slits 15 and 16 with a suitable width are cut at right angles to the beam paths or the axes of the three apertures 11, 12 and 13 in their flanges at the neck portions of the peanut shaped contiguous aperture 14; that is, at the portions at which the outer apertures 11 and 13 overlap the inner aperture 12. Strip-shaped leg portions 18 and 19 of a U-shaped partition electrode 17 are inserted into the slits 15 and 16, respectively, and the base portion of the electrode 17 is welded to the cup-shaped member as shown at X in FIG. 4.

The dimensions of the apertures 11, 12 and 13, the cathodes $K_1$, $K_2$ and $K_3$ and the U-shaped partition electrode 17 are so selected as to satisfy the following requirements:

$$S \leqq D \leqq 1.2S \quad (1)$$

$$0.3S \leqq G \leqq 0.75S \quad (2)$$

$$0.1S \leqq L \leqq 0.2S \quad (3)$$

where D is the diameter of the apertures 11, 12 and 13; S is the spacing between the beam paths; G is the overlap (See FIG. 3) and L is the distance of the leg portions 18 and 19 of the U-shaped partition electrode 17 extended out of the slits 15 and 16 (See FIG. 2).

However, the upper limit of the diameter D is 1.4S while the upper limit of the overlap G is 0.95S. The depth of the slits 15 and 16 is selected between 0.15 mm and 0.25 mm.

The accelerating electrode 20, which is in the form of a cup, has also a peanut shaped aperture 24 and a U-shaped partition electrode 27 which are symmetrical with those of the focusing electrode 10. That is, the peanut shaped aperture 24 comprises three in-line apertures 21, 22 and 23 each having the flange extended forwardly toward a screen (not shown), and the U-shaped electrode 27 has its leg portions 28 and 29 inserted into slits 25 and 26. The apertures 21, 22 and 23 and the U-shaped electrode 27 are so dimensioned as to satisfy also the requirements or conditions (1), (2) and (3) described above.

Because of the above described construction of the focusing and accelerating electrodes 10 and 20 of the in-line electron gun, three main lenses, which are formed between the focusing and accelerating electrodes 10 and 20, may have a greater diameter. Furthermore because of the correction field produced by the U-shaped partition electrodes 17 and 27, the electron lenses and beam spots may have substantially true circles; that is, their circles have negligible out-of-roundness. As a result, a color picture tube incorporating the in-line electron gun in accordance with the present invention may exhibit focusing, convergence and high-voltage characteristics.

Figure 5:
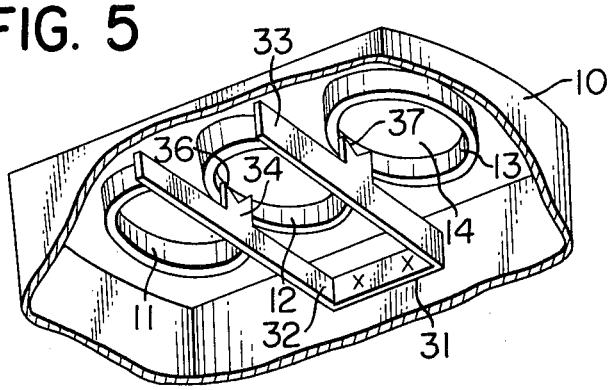
FIG. 5 is a perspective view, partly broken, of a focusing electrode of a second embodiment of the present invention.
Figure 6:
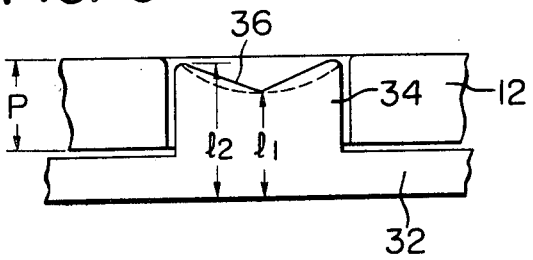
FIG. 6 is a fragmentary view, on enlarged scale, thereof, showing a projection extended from a leg portion of a U-shaped partition electrode.

Second Embodiment, FIGS. 5 and 6

In FIGS. 5 and 6 is shown a second embodiment of the present invention which is substantially similar in construction to the first embodiment described above with reference to FIGS. 2–4 except that a U-shaped partition electrode 31 is formed with projections 34 and 35 which are extended from the leg portions 32 and 33, respectively, and inserted to the neck portions, respectively, of the peanut shaped aperture 14.

Even though the apertures 11, 12 and 13 are not true circles, the provision of the projections 34 and 35 serve to produce electric fields which are substantially symmetrical about axes as will be described in detail below.

Referring back to FIG. 3, the centrally located or inner aperture 12 must be provided with a completely annular or circular flange as indicated by the dotted arcs ABC and FHJ, but according to the present invention these imaginary arcs are replaced by the chords AND and FOJ which are provided by the leg portions 18 and 19 of the U-shaped partition electrode 17. As a result, the inner aperture 12 cannot produce an electric field which is symmetrical with respect to the axis of the aperture 12. In like manner, the outer apertures 11 and 12 must be provided with a completely annular or circular flange as indicated by the imaginary arcs AEC and FMJ, but these arcs are also replaced by the chords ANC and FOJ. As a consequence, each of the outer apertures 11 and 13 also cannot produce the electric field which is symmetrical with respect to the axis.

Referring further to FIG. 6, according to the second embodiment of the present invention, the projections 34 and 35 are extended from the leg portions 32 and 33, respectively, and are formed with V-shaped recesses 36 and 37, respectively, at their free ends. Then the electric field is distributed in such a way that the intensity of the field is most weak at the center of the projection 34 or 35 and becomes progressively stronger as it moved away from the center toward the ends of the projection 34 or 35. Therefore each of the apertures 11, 12 and 13 may produce the electrode field which is substantially symmetrical with respect to the axis.

Same is true for the apertures 21, 22 and 23 of the accelerating electrode 20. Instead of the V-shaped recesses or notches 36 and 37, recesses in any suitable shape may be formed. For instance, as indicated by the broken lines in FIG. 6, arcuate or substantially arcuate recesses may be formed. In other words, each of the recesses must be such that it has the deepest depth at the center and the depth is gradually reduced as it moved away from the center toward the ends of the recess.

The dimensions of the flanges of the apertures 11, 12 and 13, the projections 34 and 36 and their recesses 36 and 37 must satisfy the following requirements or conditions when the spacing S is 5.5 mm, the diameter D is 7.0 mm and the height P of the flange is 1.5 mm.

$$1.5\ \text{mm} \leqq l_2 \leqq 4\ \text{mm}$$

$$l_1 \approx 0.785 l_2$$

where $l_1$ is the distance between the deepest point in the recess 36 and the opposite edge of the leg portion 32 and $l_2$ is the height of the projection (See FIG. 6).

Figure 7:
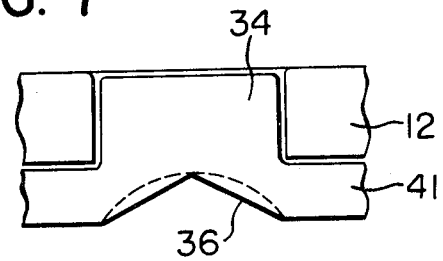
FIGS. 7, 8 and 9 show variations or modifications, respectively, of the second embodiment.
Figure 8:
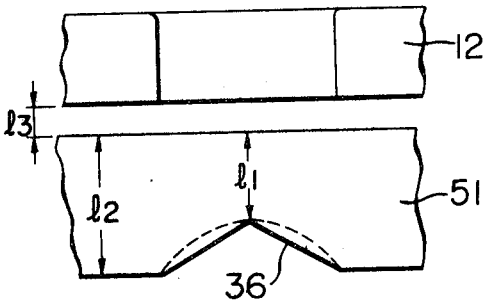
Figure 9:
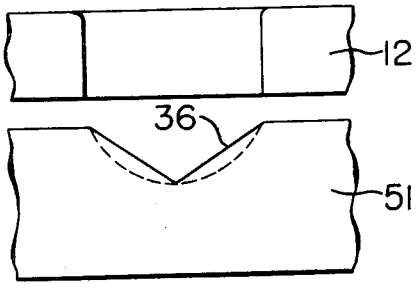

Instead of forming the V-shaped or arcuate recess at the free end of the projection 34, it may be formed at the opposite edge of the leg portion of the U-shaped partition electrode 41 as shown in FIG. 7. Alternatively, the leg portion of the U-shaped partition electrode 51 may be axially spaced apart by $l_3$ from the flanges of the apertures 11, 12 and 13 of the focusing electrode 10 as shown in FIG. 8 or 9 and the V-shaped or arcuate recess 36 may be formed at the edge of the leg portion closer to the apertures as shown in FIG. 9 or at the opposite edge as shown in FIG. 8. When S=5.5 mm and D=7 mm, $$0.5\ \text{mm} \leqq l_3 \leqq 2.0\ \text{mm}, l_1' < l_2'$$

and $$1.0\ \text{mm} < l_2' < 4.5\ \text{mm}$$

Figure 10:
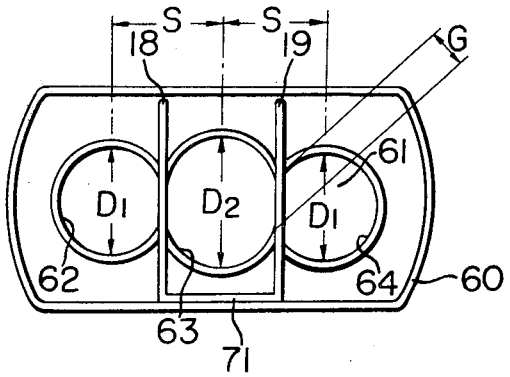
FIGS. 10, 11 and 12 show third, fourth and fifth embodiments, respectively, of the present invention.

Third Embodiment, FIG. 10

In FIG. 10 is shown a third embodiment of the present invention which is substantially similar in construction to the first embodiment described elsewhere with reference to FIGS. 2–4 except that a peanut shaped aperture 61 of a focusing electrode 60 consists of two outer apertures 62 and 64 which partially overlap a centrally located or inner aperture 63 and have the same diameter of $D_1$ and the inner aperture 63 which is circular with the diameter $D_2$ or elliptical with the major axis $D_2$, the major axis extending perpendicular to a coplane containing the axes of the apertures 62–64.

When the spacing S between the beam paths is 5.5 mm and the diameter $D_1$ of the outer apertures 62 and 64 is 7.0 mm, the diameter or the major axis $D_2$ must be $$7.0\ \text{mm} < D_2 \leqq 9.5\ \text{mm}$$

Assume that the diameter $D_1$ of the outer apertures 62 and 64 be equal to the diameter $D_2$ of the inner aperture 63 and that no partition electrode 17 be provided. Then the effect in the horizontal of the main lens formed adjacent to the inner aperture 63 is weaker than the effects in the horizontal direction of the main lenses formed adjacent to the outer apertures 62 and 64, but the effects in the vertical direction are equal. When the contiguous aperture 61 is divided into three apertures 62, 63 and 64 with the partition electrode 17 which has a suitable width (or thickness) and a suitable distance between the two leg portions thereof, the lens action on the electron beam of each of the outer main lenses may be so increased that an axially symmetrical outer main lens may be provided. As to the inner main lens, because of the out-of-roundness of the inner aperture the lens action on the electron beam in the horizontal direction is still weaker than the lens action in the vertical direction even when the U-shaped partition electrode 17 is provided so that the inner main electron lens remains axially asymmetrical. Therefore according to the third embodiment of the present invention, the diameter or the major axis $D_2$ of the inner aperture 63 is made greater than the diameter $D_1$ of the outer aperture 62 and 64 in the vertical direction. Then, the lens action on the electron beam in the vertical direction of the inner main lens is reduced in strength accordingly and made substantially equal to the lens action in the horizontal direction, whereby the axial symmetry of the inner main electron lens may be attained.

Figure 11:
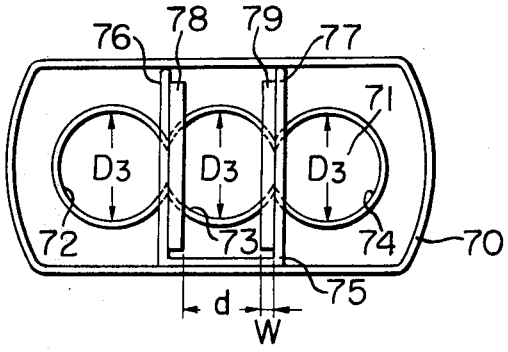

Fourth Embodiment, FIG. 11

In FIG. 11 is shown a fourth embodiment of the present invention which is substantially similar to the first embodiment described above with reference to FIGS. 2–4 except that the leg portions 76 and 77 of a U-shaped partition electrode 75 are attached with field adjustment elements or strips 78 and 79, respectively, which are made of metal and extended toward the axis of the inner aperture 73. The width of the field adjustment elements or strips 78 and 79 is equal to that of the leg portions 76 and 77 of the partition electrode 75. As a result, the diameter d in the horizontal direction of the center or inner aperture 73 is shorter than that of the center aperture 12 of the first embodiment (See FIG. 3) so that the lens action in the horizontal direction of the main lens at the center may be selectively reduced in strength and consequently the axial symmetry of the main lens may be attained.

Figure 12:
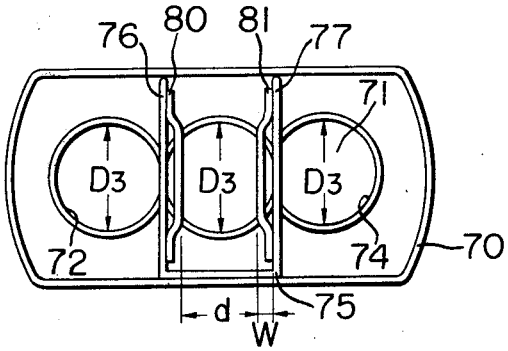

Fifth Embodiment, FIG. 12

In FIG. 12 is shown a fifth embodiment of the present invention which is substantially similar in construction and effect to the fourth embodiment described above with reference to FIG. 11 except that metallic field adjustment elements 80 and 81, which are attached to the leg portions 76 and 77 of the U-shaped partition electrode 75 are in the form of a shallow dish.

When the spacing S between the beam paths is 5.5 mm and the diameter $D_3$ of the apertures 72, 73 and 74 is 7.0 mm, the width W (See FIG. 12) of the elements 80 and 81 may be between 0.7 and 3.0 mm so that the actual diameter d in the horizontal direction of the center or inner aperture 73 may range from 2.5 to 4.5 mm.

So far the partition electrode 17, 31, 41, 51 or 75 has been described as being in the form of a letter U, but it will be understood that instead of one-piece partition electrode, two separate partition electrodes may be used. It will be also understood that the present invention may be equally applied to the accelerating electrode 20 (See FIG. 2).

What is claimed is:

1. An in-line electron gun characterized in that an elongated aperture is formed through each of the walls in predetermined spaced and opposed relationship of a focusing electrode, which form main lenses, respectively, and a final accelerating electrode; said elongated aperture consists of a center or inner aperture and two outer apertures which are partially overlapped and consequently contiguous with said center or inner aperture through two neck portions, respectively; and said elongated aperture is divided by a partition electrode means at said two neck portions into three apertures through which the three electron beams pass, respectively.

2. An in-line electron gun as set forth in claim 1 further characterized in that each of the portions, bridging said neck portions of said elongated aperture, of said partition electrode means is formed with a recess which is deepest at the center of said bridging portion and becomes shallower in depth from said center toward both the ends of said recess.

3. An in-line electron gun as set forth in claim 1 further characterized in that the ratio between the diameters in the vertical and horizontal directions of said center or inner aperture is made greater than that of said outer apertures.

4. The electron gun according to claim 1, wherein said focusing electrode walls are coplanar and said partition electrode means comprises first and second electrically conductive leg portions extending across respective ones of said neck portions in a plane adjacent the plane of said focusing electrode walls, further comprising first and second electrically conductive projections extending from said first and second leg portions respectively with the ends of said projections disposed in respective ones of said neck portions in said plane for modifying the electric fields of said main lenses to approximate fields corresponding to those produced by non-overlapping circular main lenses.

5. The electron gun according to claim 4, wherein the ends of said projections have V-shaped notches therein.

6. The electron gun according to claim 1, wherein each of said apertures comprises a circular major portion with each of said neck portions defining a chord of the adjacent apertures each chord having a length G, said circular major portions having the same diameter D and a center-to-center spacing S, said partition electrode means extending a distance L beyond said focusing electrode in the direction of electron beam passage, so that $$S \leqq D \leqq 1.2S;$$

$$0.3S \leqq G \leqq 0.75S;$$

and $$0.1S \leqq L \leqq 0.2S.$$

7. The electron gun according to claim 1, wherein said partition electrode means comprises first and second electrically conductive leg portions extending across respective ones of said neck portions, and having a gun width in the direction of electron beam passage.

8. The electron gun according to claim 1, further comprising first and second electrically conductive field adjustment members affixed to said first and second leg portions respectively, the widths of said members in said electron beam passage direction being substantially equal to the widths of said leg portions and said members being disposed between said leg portions.

9. The electron gun according to claim 8, wherein said field adjustment members are each shaped in the form of a shallow dish.

* * * * *

UNITED STATES PATENT AND TRADEMARK OFFICE

CERTIFICATE OF CORRECTION

PATENT NO. : 4,275,332

DATED : June 23, 1981

INVENTOR(S) : Shigeya Ashizaki et al.

It is certified that error appears in the above-identified patent and that said Letters Patent is hereby corrected as shown below:

Column 3, line 44, "electrode" should read -- electric --.

Column 5, Claim 1 should appear as shown below:

-- 1. An in-line electron gun characterized in that an elongated aperture is formed through each of the walls of a focusing electrode and a final accelerating electrode in predetermined spaced and opposed relationship, which walls cooperate to form main lenses; each said elongated aperture consists of a center or inner aperture and two outer apertures which are partially overlapped and consequently contiguous with said center or inner aperture

UNITED STATES PATENT AND TRADEMARK OFFICE

CERTIFICATE OF CORRECTION

PATENT NO. : 4,275,332

DATED : June 23, 1981

INVENTOR(S) : Shigeya Ashizaki et al.

It is certified that error appears in the above-identified patent and that said Letters Patent is hereby corrected as shown below:

through two neck portions, respectively; and each said elongated aperture is divided by a partition electrode means at said two neck portions into three apertures through which three electron beams pass, respectively. --.

Signed and Sealed this

Second Day of August 1983

[SEAL]

Attest:

GERALD J. MOSSINGHOFF

Attesting Officer

Commissioner of Patents and Trademarks